US010565979B1

(12) United States Patent
Christian et al.

(10) Patent No.: US 10,565,979 B1
(45) Date of Patent: Feb. 18, 2020

(54) CONCURRENT NOISE CANCELATION SYSTEMS WITH HARMONIC FILTERING

(71) Applicant: HARMAN INTERNATIONAL INDUSTRIES, INCORPORATED, Stamford, CT (US)

(72) Inventors: Jonathan Christian, Milford, MI (US); David Paul Trumpy, Novi, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/161,959

(22) Filed: Oct. 16, 2018

(51) Int. Cl.
*G10K 11/178* (2006.01)

(52) U.S. Cl.
CPC .. *G10K 11/17854* (2018.01); *G10K 11/17821* (2018.01); *G10K 11/17883* (2018.01); *G10K 2210/1282* (2013.01)

(58) Field of Classification Search
CPC ..... G10K 11/17879; G10K 11/17854; G10K 11/17821; G10K 11/17883; G10K 11/17815; G10K 2210/1282; G10K 2210/128
USPC ..... 381/71.1, 71.6, 71.4
See application file for complete search history.

(56) References Cited

U.S. PATENT DOCUMENTS 5,117,401 A * 5/1992 Feintuch ..... G10K 11/1784 367/1
5,425,105 A * 6/1995 Lo ..... G10K 11/178 381/71.8
7,885,417 B2 * 2/2011 Christoph ..... G10K 11/178 381/71.11
8,565,443 B2 * 10/2013 Wurm ..... G10K 11/178 381/71.11
10,283,105 B2 * 5/2019 Ku ..... G10K 11/178
(Continued)

FOREIGN PATENT DOCUMENTS

EP 3156998 A1 4/2017
EP 3157001 A1 4/2017

OTHER PUBLICATIONS

Glover, John R., Jr., "Adaptive Noise Canceling Applied to Sinusoidal Interferences," IEEE Transactions on Acoustics, Speech, and Signal Processing, vol. ASSP-25, No. 6, Dec. 1977, 8 pages.
(Continued)

*Primary Examiner* — Disler Paul
(74) *Attorney, Agent, or Firm* — Brooks Kushman, P.C.

(57) ABSTRACT

A noise cancellation system with harmonic filtering for a vehicle audio system may include at least one input sensor configured to transmit reference signals, and at least one input sensor configured to transmit at least two narrowband input signals each of the input signals including harmonic noise. The system may include a processor being programmed to receive the reference signals, the reference signals including at least two narrowband reference signals, receive the narrowband input signals, apply a gain reference control to the reference signals to determine whether the frequencies of each of the reference signals are within a predefined range of another, and remove one of the reference signals in response to the frequencies of each of the reference signals being within the predefined range of another to prevent common harmonic content from presiding on both reference signals during the algorithm adaption.

11 Claims, 13 Drawing Sheets

(56) References Cited

U.S. PATENT DOCUMENTS

| | | | | |
|---|---|---|---|---|
| 2009/0074199 | A1* | 3/2009 | Kierstein | G10K 11/175<br>381/71.6 |
| 2014/0086425 | A1 | 3/2014 | Jensen et al. | |
| 2016/0314778 | A1* | 10/2016 | Christoph | G10K 11/178 |

OTHER PUBLICATIONS

Tu, Yifeng, "Multiple Reference Active Noise Control," Master of Science, Mechanical Engineering, Virginia Polytechnic Institute and State University, Mar. 1997, 108 pages.

* cited by examiner

CONCURRENT NOISE CANCELATION SYSTEMS WITH HARMONIC FILTERING

TECHNICAL FIELD

Disclosed herein are noise cancelation systems with harmonic filtering.

BACKGROUND

Vehicles often generate air-borne and structural-borne noise when driven. In an effort to cancel the noise, active noise cancellation is often used to negate such noise by emitting a sound wave having an amplitude similar to the amplitude as that of the noise, but with an inverted phase. Such active noise cancelation may depend on both narrowband and broadband cancellation algorithms.

SUMMARY

A noise cancellation system with harmonic filtering for a vehicle audio system may include at least one input sensor configured to transmit reference signals, and at least one input sensor configured to transmit at least two narrowband input signals each of the input signals including harmonic noise. The system may include a processor being programmed to receive the reference signals, the reference signals including at least two narrowband reference signals, receive the narrowband input signals, apply a gain reference control to the reference signals to determine whether the frequencies of each of the reference signals are within a predefined range of another, and remove one of the reference signals in response to the frequencies of each of the reference signals being within the predefined range of another to prevent common harmonic content from presiding on both reference signals during the algorithm adaption.

A noise cancellation system with harmonic filtering for a vehicle audio system may include a processor coupled to memory and a transducer and being programmed to receive at least two narrowband reference signals, apply a gain reference control the reference signals to determine whether the frequencies of each of the reference signals are within a predefined range of another, and remove one of the reference signals in response to the frequencies of each of the reference signals being within the predefined range of another to prevent common harmonic content from presiding on both reference signals during the algorithm adaption.

A noise cancellation system method with harmonic filtering for a vehicle audio system may include receiving at least two narrowband reference signals, applying a gain reference control the narrowband reference signals to determine whether the frequencies of each of the reference signals are within a predefined range of another, and removing one of the reference signals in response to the frequencies of each of the reference signals being within the predefined range of another.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is an active noise cancelation system for increasing stability and quality when narrowband and broadband cancellation systems run simultaneously. For example, narrowband and broadband cancellation systems or algorithms often use a common error sensor and therefore both receive similar noise content. In this case, both the narrowband and the broadband algorithms may attempt to cancel the same frequency content that may have differing propagation paths. For example, some of the noise content may be airborne in nature and coherent with respect to the rotational speed signal (e.g., the engine rpm). Another portion of the noise content may be structural-borne in nature and coherent with respect to a separate reference signal such as an accelerometer on a vehicle.

In automotive applications, such coherence of the noise content may be common, especially in the steady state conditions such as drive idle where the engine noise emitted by the tailpipe is airborne in nature. This noise may be canceled using an adaptive filter method such an FxLMS, where the reference signal is provided by engine speed. At the same time, there may be an engine roll that transmits coherent structural-borne noise at the same frequency that may be canceled using the adaptive filter algorithm where the reference signals are provided by the accelerometers placed on the chassis. If the two cancelation algorithms run in parallel, instances of instability or boosting may occur.

Current systems attempt to avoid such coherence by driving different output from each the narrowband and broadband. That is, current systems operate independently in the narrowband and broadband and as a result cannot operate in overlapping frequency regions. However, this is inefficient and can be inaccurate. The system disclosed herein filters out the common narrowband harmonic content from the error and/or reference signals. This prevents the broadband cancellation algorithm from providing output that is coincident with the narrowband content. If the narrowband content is filtered out of the error and/or reference signal, then the broadband algorithm should not adapt to the harmonic content ensuring, a more stable system. This method is computationally more efficient than other coherence processing. The system may allow for lower latency as the computational demand on the DSP is lower.

Figure 1:
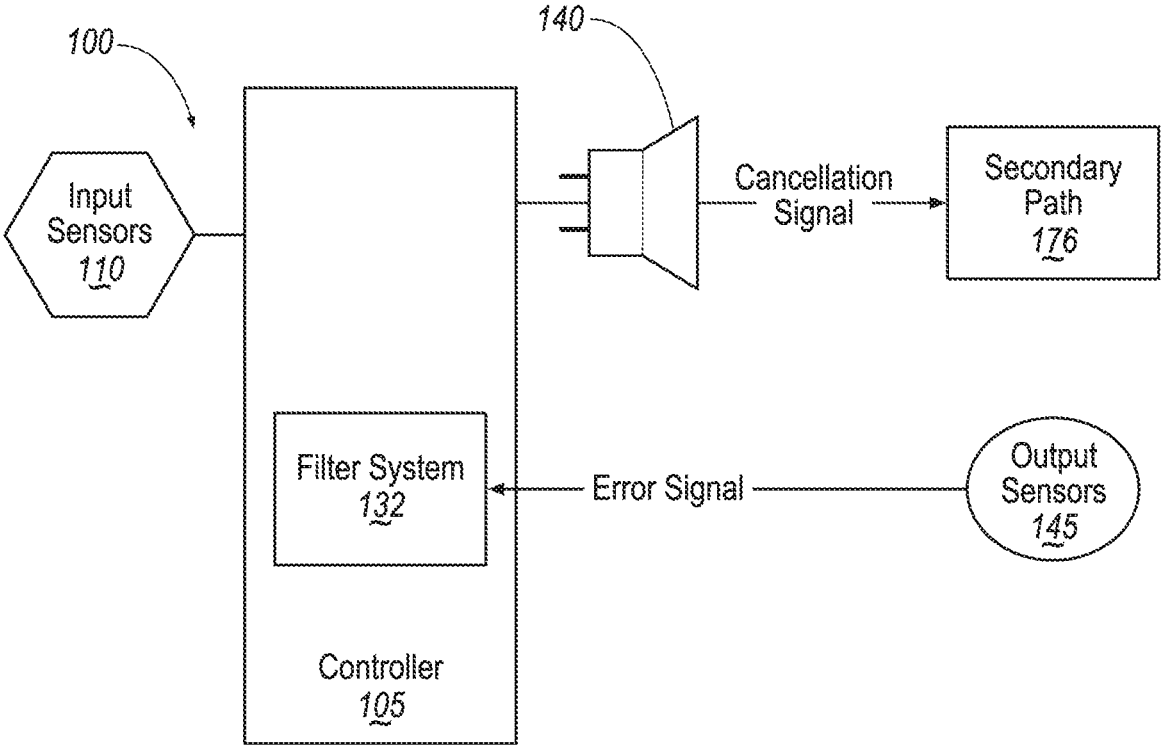
FIG. 1 illustrates an example active noise cancelation system in accordance with one embodiment.

FIG. 1 illustrates an example active noise control system 100 having a controller 105, at least one input sensor 110, and at least one transducer 140. The controller 105 may be a stand-alone device that includes a combination of both hardware and software components and may include a processor configured to analyze and process audio signals. Specifically, the controller 105 may be configured to perform broadband and narrowband noise cancelation for engine order cancelation (EOC) and/or active road noise cancellation (ARNC), within a vehicle based on received data from the input sensor 110. The controller 105 may include various systems and components for achieving ANC such as an adaptive filter system 132. The controller 105 may also be running concurrent narrowband system, such as EOC.

The input sensor 110 may be configured to provide an input or reference signal to the controller 105. The input sensor 110 may include an accelerometer configured to detect motion or acceleration and to provide an accelerometer signal to the controller 105. The acceleration signal may be indicative of a vehicle acceleration, engine acceleration, wheel acceleration, etc. The input sensor 110 may also include a microphone and/or a sound intensity sensor configured to detect noise. The input sensor 110 may detect both narrowband noise and broadband noise, as described in more detail with respect to FIG. 2. The input sensor 110 may also detect multiple sets of noise including a first narrowband noise signal set and a second narrowband noise signal set. For narrowband systems, the input sensor may simply be the engine RPM, engine torque, or other reference signals.

The transducer 140 may be configured to audibly generate an audio signal provided by the controller 105 at an output channel (not labeled). In one example, the transducer 140 may be included in a motor vehicle. The vehicle may include multiple transducers 140 arranged throughout the vehicle in various locations such as the front right, front left, rear right, and rear left. The audio output at each transducer 140 may be controlled by the controller 105 and may be subject to noise cancellation, as well as other parameters affecting the output thereof. The transducer 140 may provide the noise cancellation signal to aid in the RNC to improve the sound quality within the vehicle.

The active noise control (ANC) system 100 may include a feedback or output sensor 145, such as a microphone, arranged on a secondary path 176 and may receive audio signals from the transducer 140. The feedback sensor may be a microphone configured to transmit a microphone output signal or error signal, to the controller 105. The feedback sensor may also receive undesired noise from the vehicle such as road noise and engine noise.

Figure 2:
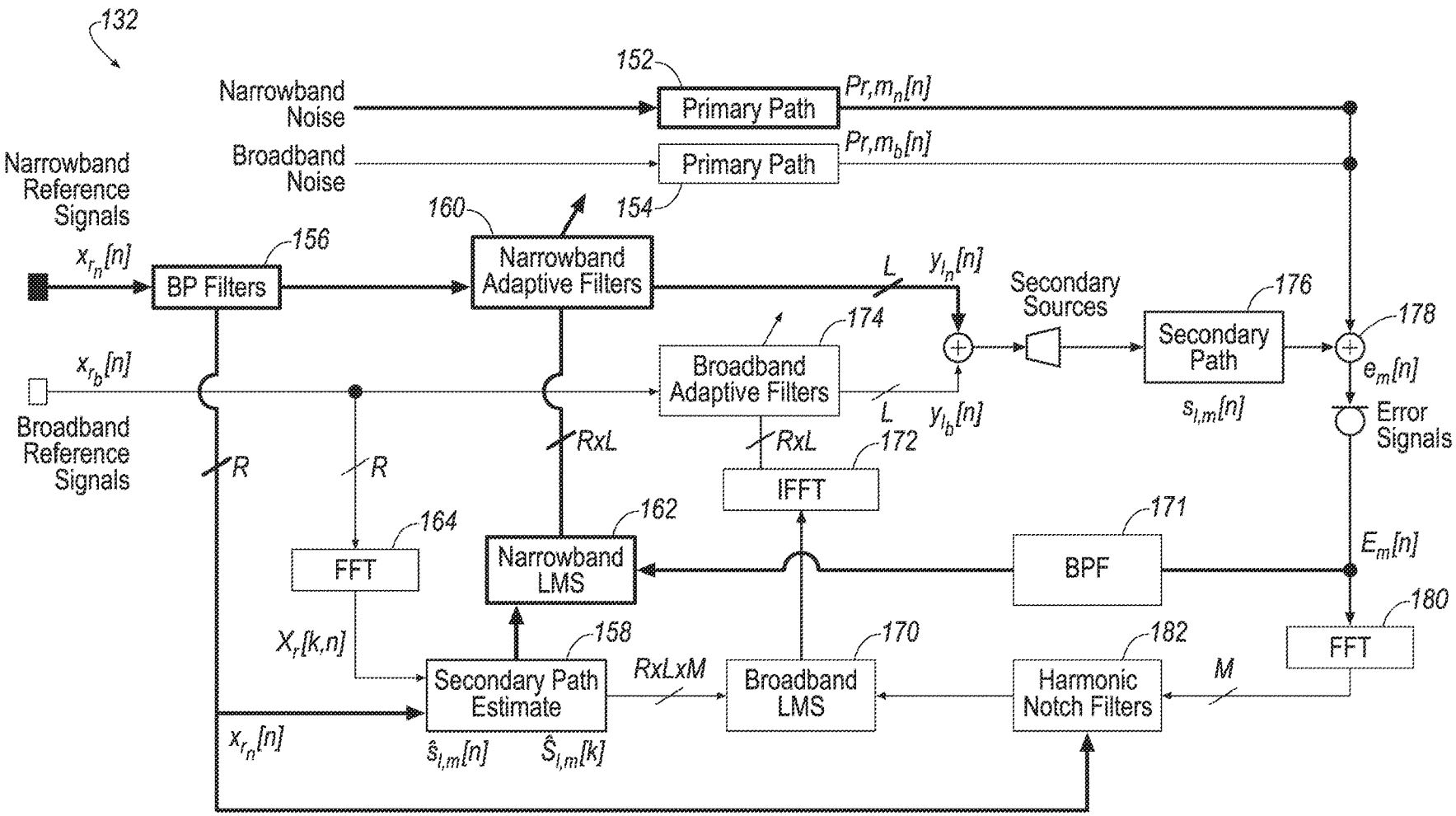
FIG. 2 illustrates an example narrowband and broadband filter system of the system of FIG. 1.

FIG. 2 illustrates an example narrowband and broadband filter system 132 of the ANC system 100. The narrowband filter system 132 may include a narrowband primary path 152 supplying a time dependent primary narrowband propagation noise signal $P_{r,mn}[n]$ and a broadband primary path 154 supplying a time dependent primary broadband propagation noise signal $P_{r,mb}[n]$. In one example, the narrowband propagation path $P_{r,mn}[n]$ may be acquired by a microphone, accelerometer, sound intensity sensor, etc. as it correlates to one or more speed sensors configured to detect rotation of shafts of the engine fan or other RPM related noise. The broadband noise broadband propagation path $P_{r,mb}[n]$ may be acquired from a microphone, accelerometer, sound intensity sensor, etc.

The system 132 may receive two feed forward reference signals, a narrowband reference signal $x_{rn}[n]$ and a broadband reference signal $x_{rb}[n]$. Additionally or alternatively, the two feed forward reference signals could be two narrowband reference signals, as explained in further detailed below with respect to FIG. 10. Each of the reference signals may include harmonic noise. The narrowband reference signal $x_{rn}[n]$ may be supplied to a bandpass filter 156. The bandpass filter 156 may filter certain frequencies from the narrowband reference signal $x_{rn}[n]$, which is then supplied to a narrowband adaptive filter 160 and then on to the secondary path 176.

The broadband reference signal $x_{rb}[n]$ may be supplied to a broadband adaptive filter 174. The broadband adaptive filter 174 may filter the broadband reference signal $x_{rb}[n]$ and generate a broadband secondary signal $y_{lb}[n]$.

The broadband reference signal $x_{rb}[n]$ and the time dependent primary narrowband propagation path $P_{r,mn}[n]$ may be provided to a Fast Fourier Transform block 164. An FFT may be applied to the broadband reference signal $x_{rb}[n]$ secondary path estimate block 158.

The secondary path estimate block 158 may estimate a secondary path in the frequency domain $\hat{S}_{l,m}[k]$ and an estimated secondary path in the time domain $\hat{s}_{l,m}[k]$. The secondary path estimate block 158 may provide a R×L×M matrix to a broadband least mean squared block 170, where:

R is the total dimensional number of reference signals,

L is the total dimensional number of secondary sources, and

M is the total dimensional number of error signals.

The broadband least mean square (LMS) block 170 may be a sum cross-spectrum comparator configured to provide a vector to apply filter coefficients of the least mean square of the error signals. An inverse FFT may then be applied to this signal at the IFFT bock 172. An R×L matrix may then be supplied to a broadband adaptive filter 174.

The secondary path estimate block 158 may also provide an R×L×M matrix to a narrowband least mean squared (LMS) block 162 which may be a sum cross-spectrum comparator or time domain comparator configured to provide a vector configured to apply filter coefficients of the least mean square of the error signals. The narrowband least mean squared block 162 may provide an R×L matrix to the narrowband adaptive filters 160. A bandpass filter (BPF) 171 may be arranged between the summed error signal and the narrowband LMS 162 for time alignment.

The broadband adaptive filter 174 may supply the broadband secondary source signal $y_{lb}[n]$ and the narrowband adaptive filter 160 may provide narrowband secondary source signal $y_{ln}[n]$, each summed with the other. The summed secondary source signals $y_{lb}[n]$, $y_{ln}[n]$ may then pass through the secondary path $s_{l,m}[n]$ 176. The secondary path $s_{l,m}[n]$ 176 represents the electroacoustic transfer function of the system (electronics, speakers, microphones, and interior vehicle acoustics).

At summation 178, the antinoise signals broadcast via secondary path $s_{l,m}[n]$ 176, primary paths 152, and 154, sum resulting in an error signal $e_m[n]$ . The error signal $e_m[n]$ may be acquired from the output sensors 145 such as a microphone. The summed signal may be input into a Fast Fourier Transform 180 forming an estimated error signal $E_m[n]$.

A harmonic notch filter 182 may then be applied to the estimated error signal $E_m[n]$, using the narrowband reference signal, $x_{nb}[n]$. The harmonic notch filter 182 is described in more detail herein with respect to FIG. 7. The harmonic notch filter 182 may filter out the harmonic signals in the error signal $E_m[n]$. The broadband signal may then adapt without the narrowband signal and without taking into consideration the harmonic noise in the error signal $E_m[n]$.

The harmonic notch filter 182 subtracts the output of a narrowband harmonic content from $E_m[n]$. The adaptive filter 240 transforms the narrowband reference signal to the best estimate of the narrowband interference present in $E_m[n]$. The LMS 170 (or similar) algorithm updates the adaptive filter coefficients using feedback from $E_{m\text{-}flt}[k,n]$. The adaptive filter 240 can be one of several filter structures: FIR, IIR, or simply sinusoids with adjustable magnitude and phase.

Figure 3:
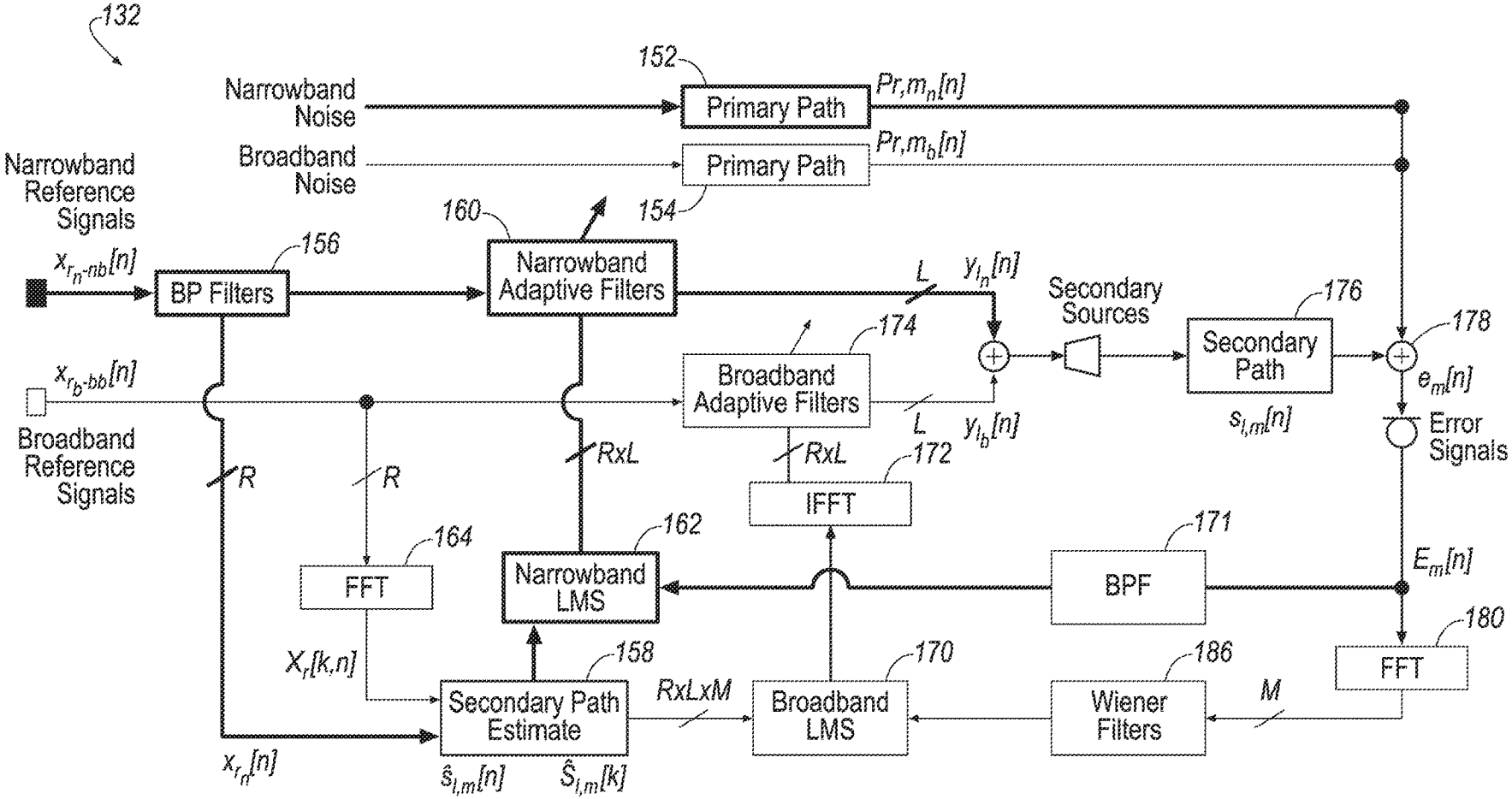
FIG. 3 illustrates another example narrow band and broadband filter system of the system of FIG. 1.
Figure 5:
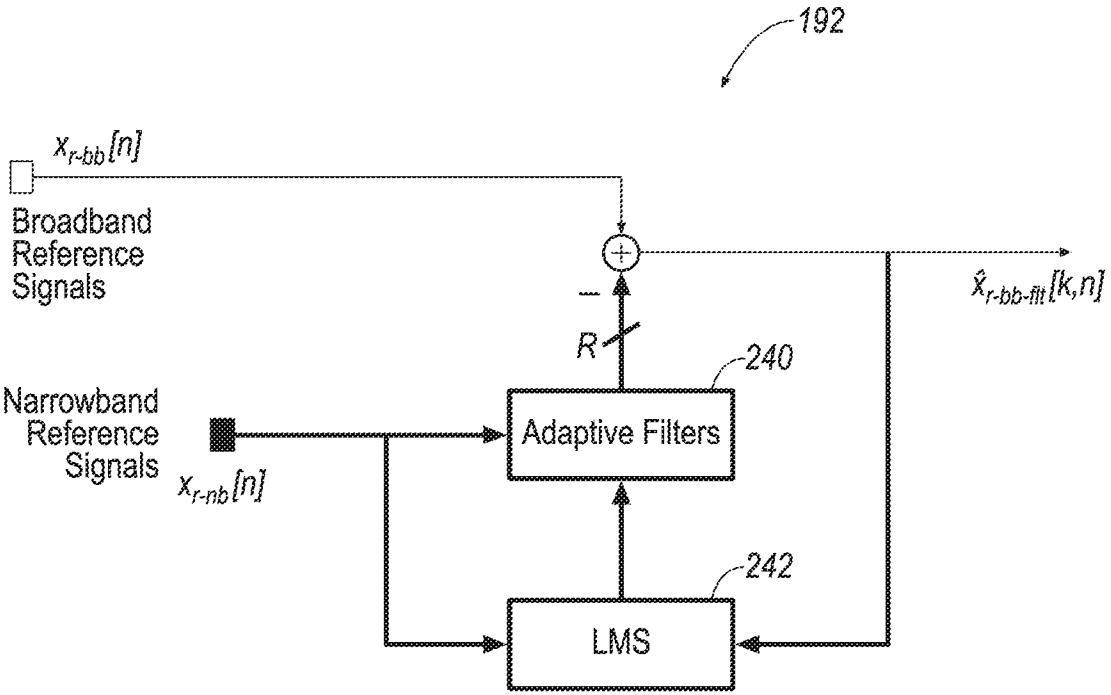
FIG. 5 illustrates an example adaptive notch filter.
Figure 7:
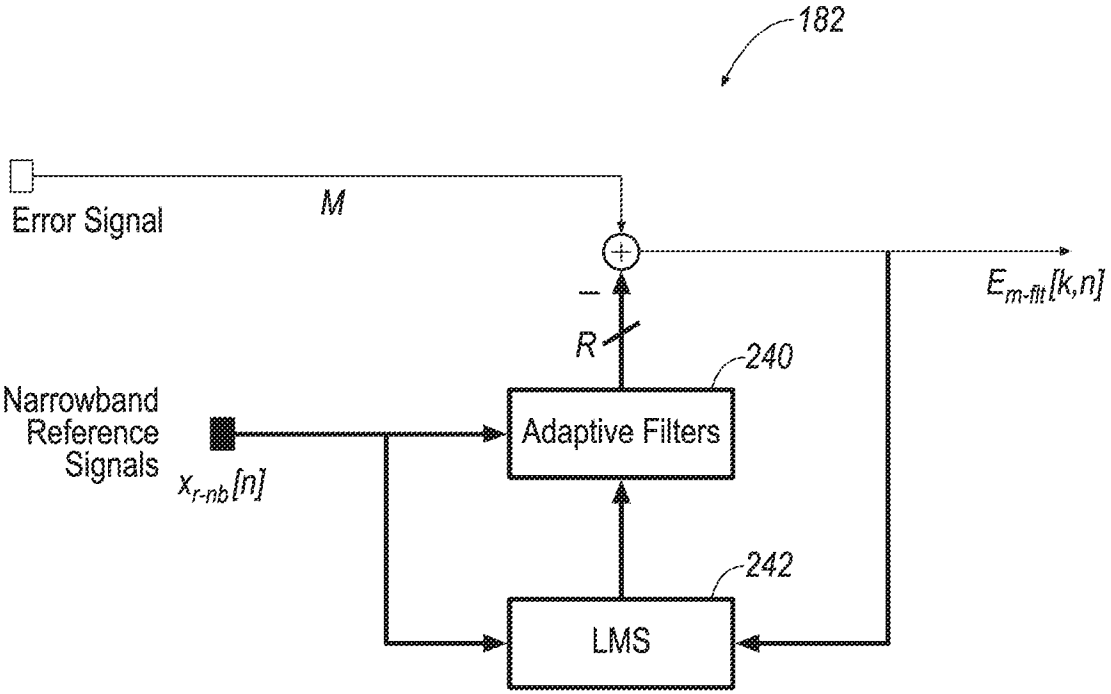
FIG. 7 illustrates an example harmonic notch filter as applied for error and reference signals.

FIG. 3 illustrates an example narrowband filter system 132 of the ANC system 100 similar to FIG. 2, except that the harmonic notch filter 182 is replaced with a Wiener filter 186. The Weiner filter may estimate the harmonic noise based on the reference signals $x_{rb}[n]$, $x_{rn}[n]$, and filter the noise from the broadband error signal $E_m[n]$. The narrowband interference cancellation may remove the narrowband content from the broadband error signal. The narrowband interference may be performed by several mechanisms. One example is to use LMS as shown in FIGS. 5 and 7. By using LMS, prior matrix inversion methods are unnecessary. Another example is to use RLS (recursive least squares) or other adaptive filters. Further, forward-backwards linear prediction may also be used. In this case, the Weiner filter 186 may be implemented.

The harmonic notch filter 182 illustrated in FIGS. 2 and 7 and the Weiner filter 186 illustrated in FIG. 3 may allow for the harmonic content to be separated from the broadband content. This prevents the road noise cancelation system from adapting to harmonic content at least because the harmonic content has been removed from the error signals. The use of a notch filter may allow for phase distortion and loss of broadband content. The use of a Wiener filter may work best when the signals are uncorrelated, or there may be partially correlation.

Figure 4:
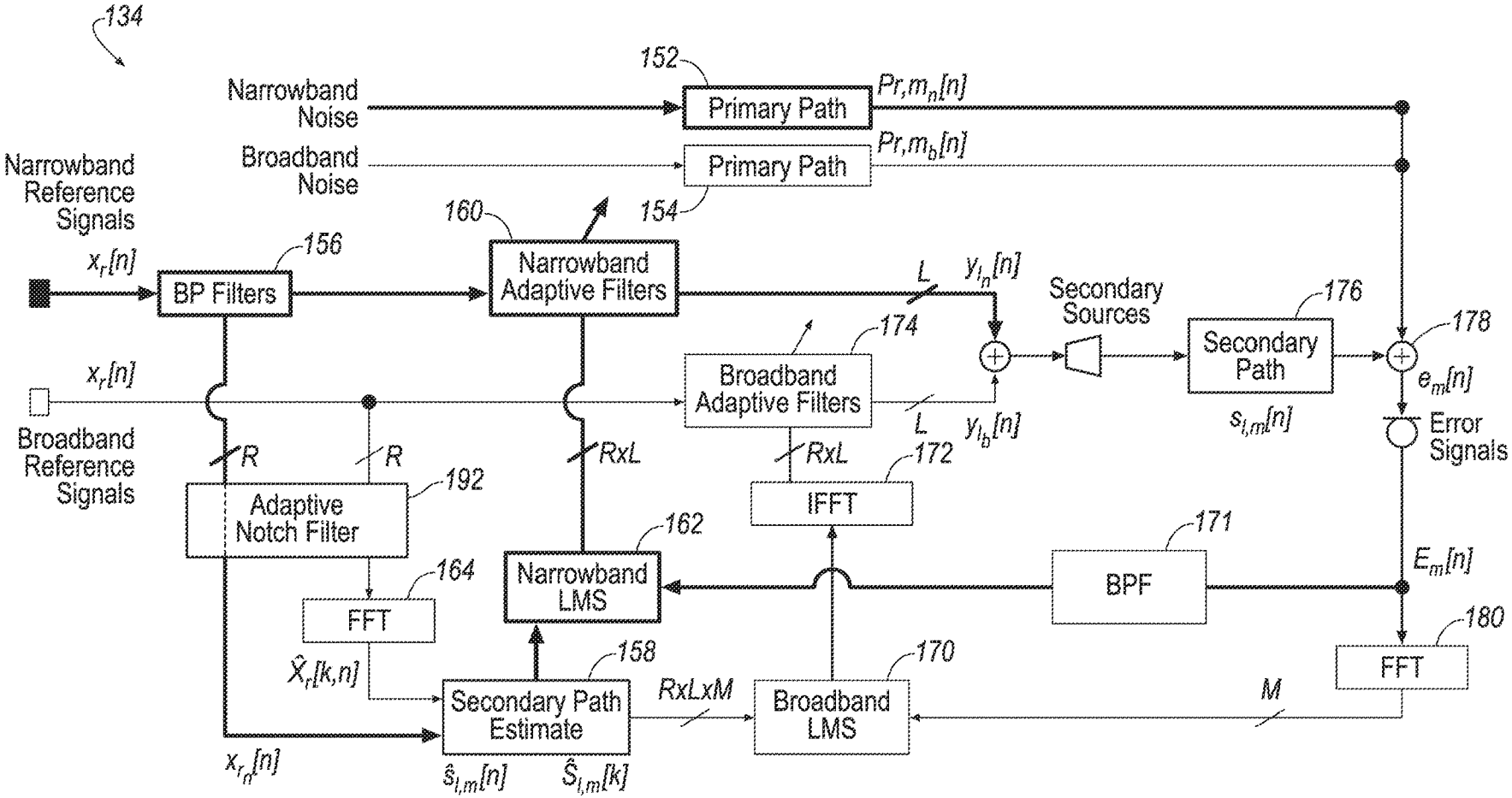
FIG. 4 illustrates another example narrowband and broadband filter system of the system of FIG. 1.

FIG. 4 illustrates an example narrowband filter system 132 of the ANC system 100 similar to FIG. 2, except that an adaptive notch filter 192 is arranged between the bandpass filters 156 and the secondary path estimate block 158. In this example, the adaptive notch filter 192 is illustrated as receiving both the narrowband reference signal $x_{rn}[n]$ and the broadband reference signal $x_{rb}[n]$. However, in another example, the adaptive notch filter 192 may only receive the broadband reference signal $x_{rb}[n]$. In this latter example, the adaptive notch filter 192 may filter harmonic content from the broadband reference signal $x_{rb}[n]$ in an effort to avoid duplicity of the harmonic content in both the narrowband and broadband. If both the narrowband and broadband include similar harmonic noise, and each of the narrowband and broadband are filtered separately, then the narrowband filtering may cancel the same frequency content as the broadband filtering. This may create instability or boosting and lead to poorer noise cancelation.

FIG. 5 illustrates an example adaptive notch filter 192. The harmonic content is separated from the broadband content via the notch filter by applying an adaptive filter 240 and LMS 242 to the narrowband reference signal $x_{r\text{-}nb}$ [n]. The adaptive filter 240 may be similar to the narrowband adaptive filter 160 and configured to apply filter coefficients of the least mean square of the error signals. The LMS 242 may be similar to the narrowband LMS block 162 and may provide a dimension R matrix to the adaptive filter 240.

Figure 6A:
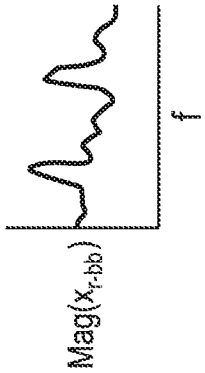
FIG. 6A illustrates a graphical representation of the magnitude of the broadband reference signal ($x_{r\text{-}bb}$) spectra.
Figure 6B:
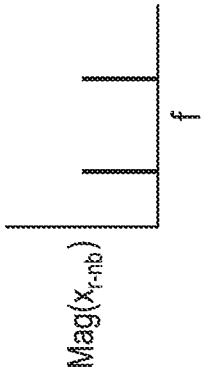
FIG. 6B illustrates a graphical representation of the magnitude of the narrowband reference signal $x_{r\text{-}nb}$.

FIG. 6A illustrates a graphical representation of the magnitude of the broadband reference signal $x_{r\text{-}bb}$ in the frequency domain FIG. 6B illustrates a graphical representation of the magnitude of the narrowband reference signal $x_{r\text{-}nb}$ in the frequency domain. In the example illustrated, the magnitude of the narrowband reference signal $x_{r\text{-}nb}$ includes two peaks. These two peaks may correlate with magnitudes of the broadband reference signal $x_{r\text{-}bb}$. Due to this correlation, similarity between the broadband and narrowband references signals is identified. Because of this similarity, and because of current noise cancelation systems, the narrowband and broadband reference signals may attempt to cancel this similar content. Filtering the similar narrowband content from the broadband reference signals may allow for more accurate noise cancelation.

Figure 6C:
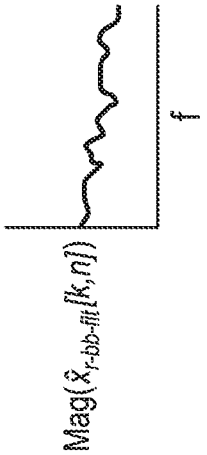
FIG. 6C illustrates a graphical representation of the magnitude of the reference signal spectra with the adaptive notch filter applied $\hat{x}_{r\text{-}bb\text{-}flt}[k,n]$.

FIG. 6C illustrates a graphical representation of the magnitude of the reference signal in the time domain with the adaptive notch filter applied $\hat{x}_{r\text{-}flt}[k,n]$. As illustrated, the correlated peaks present prior to filtering are no longer present. Thus, the content similar between the narrowband and broadband reference signals has been removed from the broadband reference signal allowing for a more appropriate reference signal for purposes of noise cancellation.

FIG. 7 illustrates an example harmonic notch filter 182, similar to the harmonic notch filter 182 of FIG. 2. The harmonic content is separated from the broadband content via the harmonic notch filter 182 by applying an adaptive filter 240 and LMS 242 to the narrowband reference signal $x_{r\text{-}nb}[n]$. The filtered narrowband reference signal is removed from the error signal $E_m[n]$ to generate the filtered error reference signal $E_{m\text{-}flt}[k,n]$.

Figure 8A:
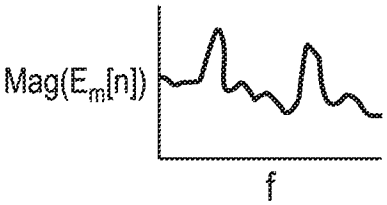
FIG. 8A illustrates a graphical representation of the magnitude of the error signal $E_m$.

FIG. 8A illustrates a graphical representation of the magnitude of the error signal $E_m[n]$ in the frequency domain.

Figure 8B:
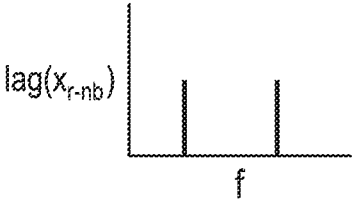
FIG. 8B illustrates a graphical representation of the magnitude of the narrowband reference signal $x_{r\text{-}nb}$ spectra.

FIG. 8B illustrates a graphical representation of the magnitude of the narrowband reference signal $x_{r\text{-}nb}$ in the frequency domain similar to FIG. 6B.

Figure 8C:
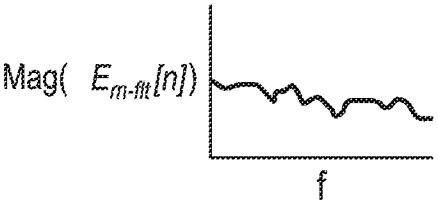
FIG. 8C illustrates a graphical representation of filtered error reference signal $E_{m\text{-}flt}$ spectra.

FIG. 8C illustrates a graphical representation of filtered error reference signal $E_{m\text{-}flt}[k,n]$. As illustrated, the correlated peaks present prior to filtering are no longer present in the filtered error reference signal $E_{m\text{-}flt}[k,n]$. Thus, the content similar between the error and narrowband reference signals has been removed from the error signal, allowing for a more appropriate signal for purposes of ANC system adaption.

Figure 9:
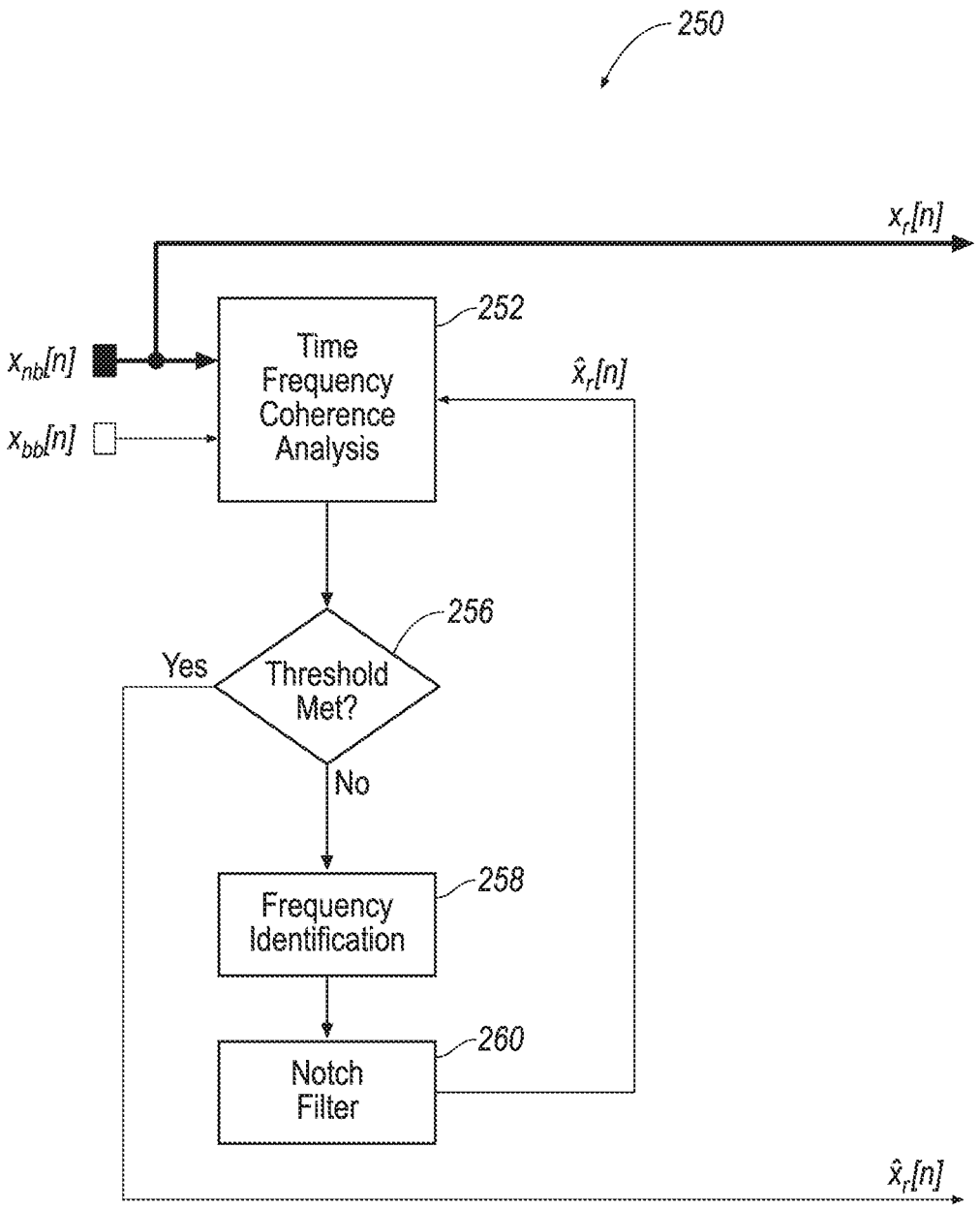
FIG. 9 illustrates an adaptive reference filter system.

FIG. 9 illustrates an adaptive reference filter system 250. Coherence calculations may only be valid for stationary processes that are stochastic and whose joint probability does not change when shifted in time. Stationary processes are an underlying assumption in certain statistical calculation that use time series analysis. Cross-spectrum analysis within the coherence calculation may depend on the stochastic process. Additionally, some narrowband reference signals do not have a mean of 0. For these reasons, it may be beneficial to use time-frequency coherence to evaluate the reference signals $x_{rm}[n]$, $x_{rb}[n]$.

The adaptive reference filter system 250 may include a time frequency coherence analysis block 252. This block 252 may compare the narrowband reference signal $x_{rm}[n]$ and the broadband reference signal $x_{rb}[n]$ to determine the coherence between the two signals. In one example, wavelet coherence may be used to detect oscillations in the non-stationary signals. The time frequency coherence analysis block 252 may determine a coherence value based on the comparison.

At block 256, the controller 105 may determine whether that coherence value meets or exceeds a coherence threshold. The threshold may be a minimum amount of coherence. This value may be defined as any number X where $0<X\leq 1$. In one example, the wavelet coherence could be 0.5 or greater. Thus, a value of 0.5 or greater could trigger the filtering process. If the threshold is not met, then the controller 105 may identify the frequency at which the coherence is not met in frequency identification block 258 and apply a notch filter at that frequency at block 260. The controller 105 may apply notch filters until the threshold is met for each frequency.

Figure 10:
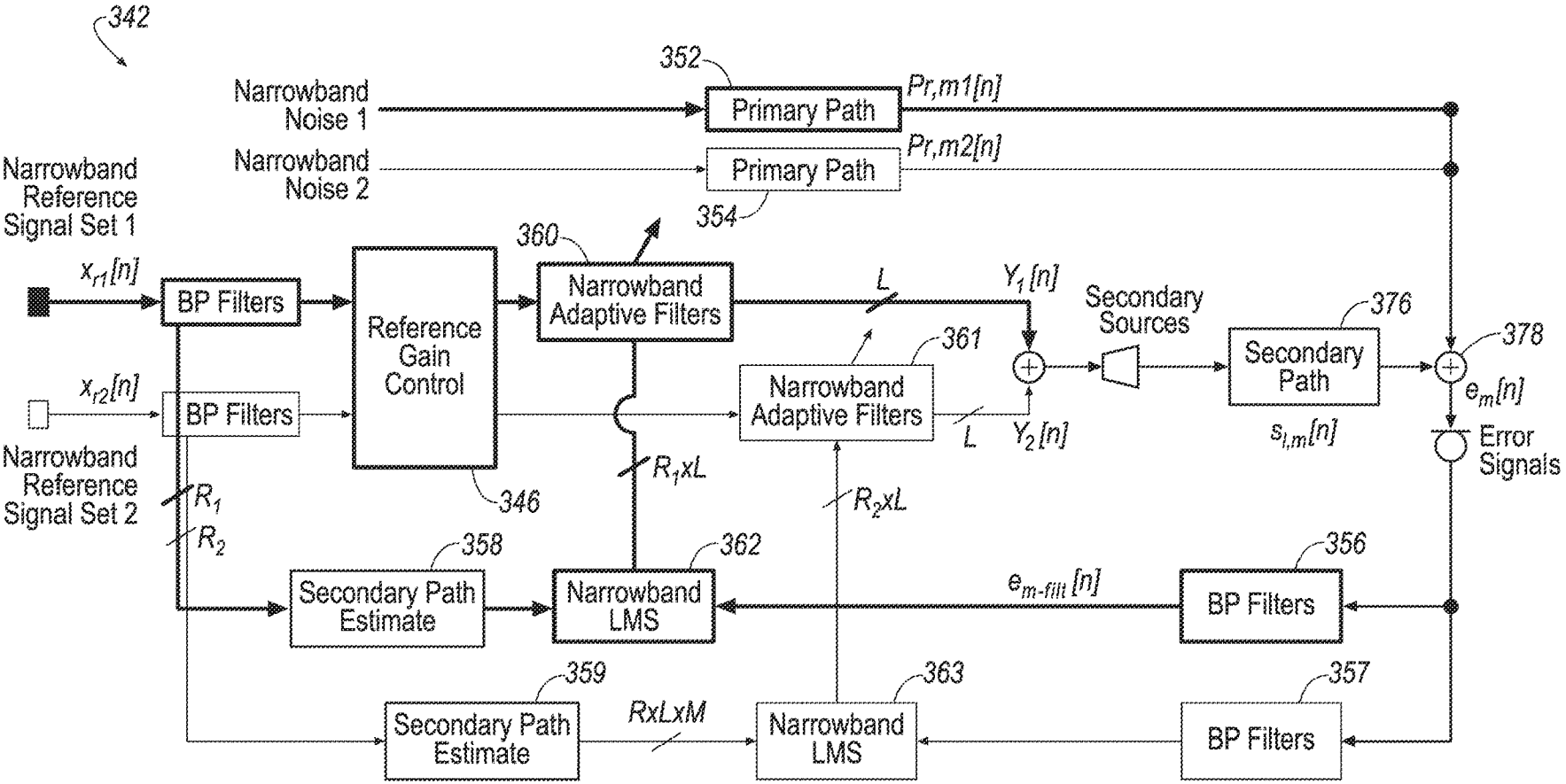
FIG. 10 illustrates another example of two concurrent narrowband adaptive filter systems comparable to the system in FIG. 1.
Figure 11:
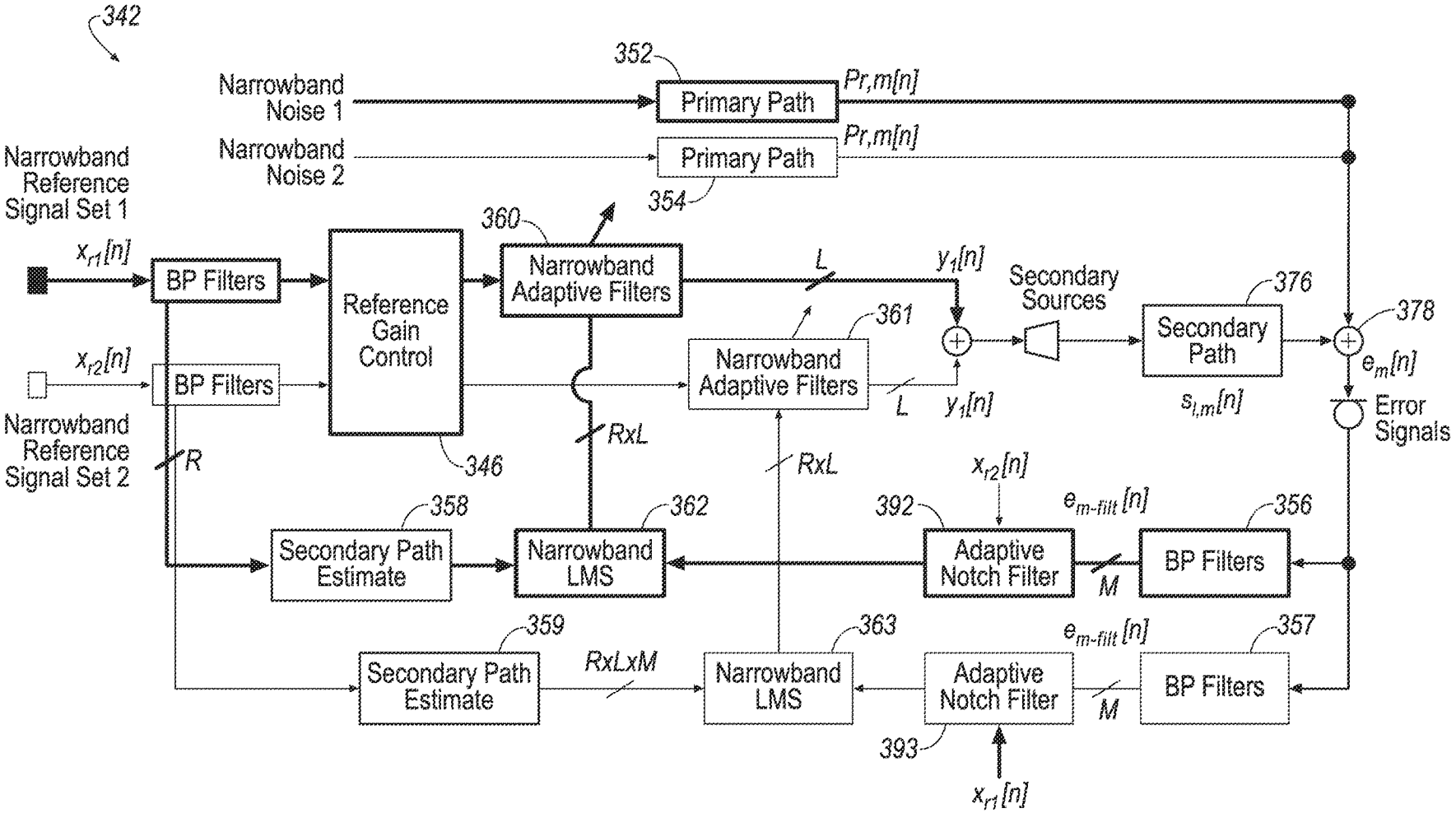
FIG. 11 illustrates another example of two concurrent narrowband adaptive filter systems comparable to the system in FIG. 1.

Referring to FIGS. 10 and 11, in addition to scenarios where there is a broadband and narrowband reference, there may also be systems with two (or more) independent narrowband references. As these narrowband signals come closer together in frequency, beating effects can occur because of the rolloff of the tracking bandpass filters.

FIG. 10 illustrates an example narrowband filter system 342 of the ANC system 100 for concurrent multiple input, multiple output least mean square systems with adaptive reference filtering applied to multiple narrowband signals with different references. The filter system 342 may include a narrowband primary path 352 supplying a time dependent first narrowband primary propagation path $P_{r,m1}[n]$ and a second primary narrowband propagation path 354 supplying a time dependent primary narrowband propagation path $P_{r,m2}[n]$. The primary noise signals 352, 354 may be acquired by the output sensors 145 (as shown in FIG. 1).

The system 342 may receive two feed forward reference signals (e.g., input signals), a first narrowband reference signal $x_{r1}[n]$ and a second narrowband reference signal $x_{r2}[n]$. Each of the reference signals may include harmonic noise. The narrowband reference signals $x_{r1}[n]$, $x_{r2}[n]$ may be supplied to a reference gain control 346. The reference gain control 346 may tune the reference signals $x_{r1}[n]$, $x_{r2}[n]$ to favor the cancellation of one noise signal over the other. As the frequencies of the two system become closer together, one reference may be turned off, thus disabling the cancellation for that order. This may still leave some noise present in the system.

The controller 105 may determine whether the frequencies of the narrowband reference signals are within a predefined threshold of one another. If so, then the controller 105 may remove one of the reference signals from consideration. The threshold may be related to frequency, magnitude, or coherence, just to name a few. In one example, if two reference signals are going to generate the same frequency content (but maybe different phase), then one of the reference signals may be muted when they are within 5 Hz of each other. This may be beneficial when it is known that one of the noise sources linked to a reference signal is clearly more dominant than the other in certain frequency ranges. Likewise, one signal may be muted based on the magnitude of the reference signals, e.g., if the magnitudes are within 3 dB of each other. Again, this is accounting for some phase mismatch where if the signals are appreciably similar in amplitude, then boosting may be prevented.

The reference signals $x_{r1}[n]$, $x_{r2}[n]$ may each be supplied to a respective first secondary path estimate block 358 and second secondary path estimate block 359. The secondary path estimate blocks 358, 359 may estimate a secondary path for each the time domain and the frequency domain and determine an estimated secondary path in the frequency domain $\hat{S}_{l,m}[k]$ and an estimated secondary path in the time domain $\hat{s}_{l,m}[k]$. Notably, these secondary paths could be unique or common. For example, a first reference signal may play only from the rear subwoofer because that specific speaker couples into the tailpipe noise which is the dominant source. In that example, the other speakers are used for the second reference signal set. The secondary path estimate blocks 358, 359 may provide a R×L×M matrix to a broadband least mean squared block 170, where:

R is the total dimensional number of reference signals,

L is the total dimensional number of secondary sources, and

M is the total dimensional number of error signals.

The secondary path estimate blocks 358, 359 may provide the R×L×M matrices to respective first narrowband least mean squared (LMS) block 362 and second narrowband least mean squared (LMS) block 363. The LMS blocks 362, 363 may be adaptive filters configured to apply filter coefficients of the least mean square of the error signals. The narrowband least mean squared blocks 362, 363 may provide an $R_1\times L$ matrix to a first narrowband adaptive filter 360, and an $R_2\times L$ matrix to a second narrowband adaptive filter 361.

The first narrowband adaptive filter 360 may supply a first secondary source signal $y_1[n]$ and the second narrowband adaptive filter 361 may supply a second secondary source signal $y_2[n]$, each summed with the other. The summed secondary source signals $y_1[n]$, $y_2[n]$ may then pass through the secondary path $s_{l,m}[n]$ 376. Again, this could be a common secondary path or unique secondary path as in the estimates shown in FIG. 10. The secondary path $s_{l,m}[n]$ 376 represents the transfer function of the acoustic system (speakers, microphones, and interior vehicle acoustics).

At summation 378, the signals broadcast via the secondary path $s_{l,m}[n]$ 376, primary paths 352, 354 may sum, resulting in an error signal $e_m[n]$. The error signal $e_m[n]$ may be acquired from the output sensors 145 such as a microphone. The summed signal may be input into a first bandpass filter 356 and second bandpass filter 357, which may filter certain frequencies from the error signal $e_m[n]$. The filtered error signal is then supplied to the respective first narrowband LMS block 362 and the second narrowband LMS block 363.

FIG. 11 illustrates an example narrowband filter system 342 of the ANC system similar to FIG. 10, except that a first adaptive notch filter 392 is arranged between the first bandpass filter 356 and the first LMS block 362. Further, a second adaptive notch filter 393 is arranged between the second bandpass filter 357 and the second LMS block 363. The adaptive filters 392, 393 then may filter harmonic content from the filtered error signal in an effort to avoid duplicity of the harmonic content in both the first and second narrowband signals. If both the narrowband signals include similar harmonic noise, and each of the narrowband signal sets are filtered separately, then the filtering may cancel the same frequency content in each signal set. This may create instability or boosting and lead to poorer noise cancelation.

That is, in order to automatically isolate the error signals related to the two references, and adaptive filters 392, 393 may be utilized to subtract out the noise component of first reference prior to the adaptive filter that is responsible for cancelling signals related to the second reference. A parallel system may also run that isolates only the noise related to the $1^{st}$ reference in the same manner. This could be repeated for more than two narrowband reference signals. In this system, the Reference Gain Control block 346 may be adjusted to keep both references active based on the performance of the narrowband adaptive filter, and thus maximizing the amount of cancellation in the system.

Figure 12:
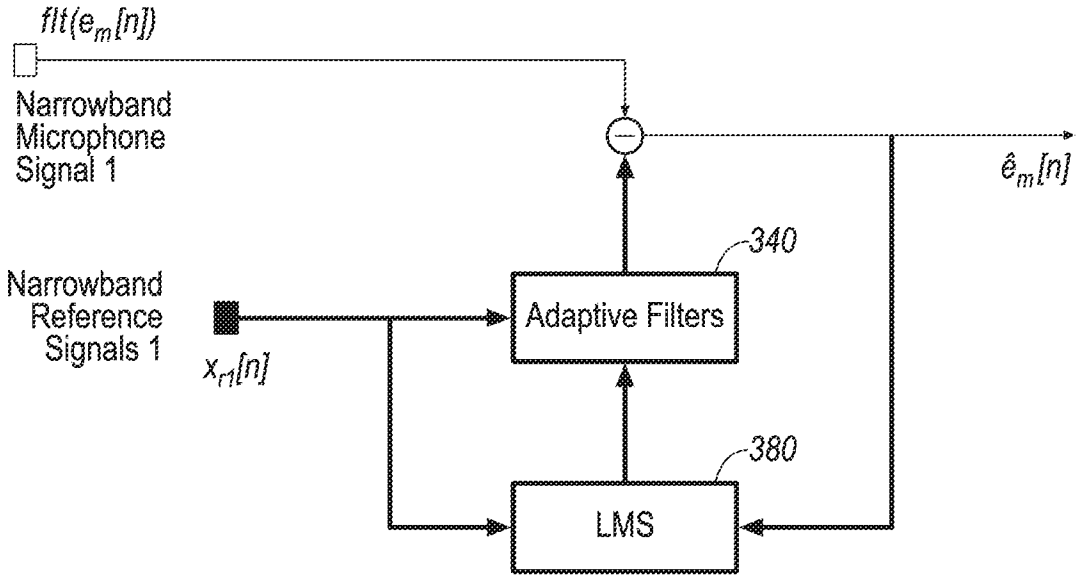
FIG. 12 illustrates an example of an adaptive harmonic notch filter.

FIG. 12 illustrates an example harmonic notch filter 392 or harmonic notch filter 393. The harmonic content is separated from the broadband content via the notch filter by applying an adaptive filter 340 and LMS 380 to the first narrowband reference signal $x_{r1}[n]$. The adaptive filter 340 may be similar to the narrowband adaptive filter 160 and configured to apply filter coefficients of the least mean square of the error signals. The LMS 380 may be similar to the narrowband LMS block 162 and may provide an R×L matrix to the adaptive filter 340.

Figure 13A:
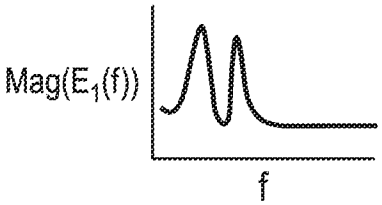
FIG. 13A illustrates an example illustrates a graphical representation of the magnitude of the error signal $E_1$ spectra.

FIG. 13A illustrates a graphical representation of the magnitude of the error signal $E_1$ in the frequency domain.

Figure 13B:
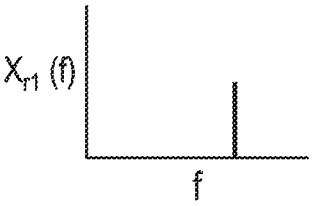
FIG. 13B illustrates an example graphical representation of the magnitude of the reference signal $X_{r1}$ spectra.

FIG. 13B illustrates a graphical representation of the magnitude of the reference signal $X_{r1}$ in the frequency domain. In the example illustrated, the magnitude of the reference signal $X_{r1}$ includes one peak. This peak may correlate with magnitudes of the error signal $E_1(f)$. Due to this correlation, similarity between the broadband and narrowband references signals is identified. Because of this similarity, and because of current noise cancelation systems, the two narrowband reference signals may attempt to cancel this similar content if the frequencies are appreciably close together.

Figure 13C:
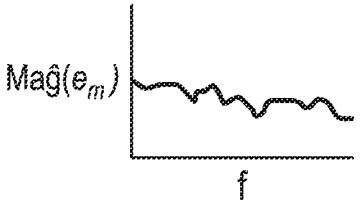
FIG. 13C illustrates a graphical representation of the magnitude of the error signal $\hat{e}_m$]spectra.

FIG. 13C illustrates a graphical representation of the magnitude of the reference signal in the frequency domain with the error signal $\hat{e}_m$. As illustrated, the correlated peaks present prior to filtering are no longer present. Thus, the content similar between the two narrowband reference signals has been removed from one of the reference signals, allowing for a more appropriate reference signal for purposes of noise cancellation.

Figure 14:
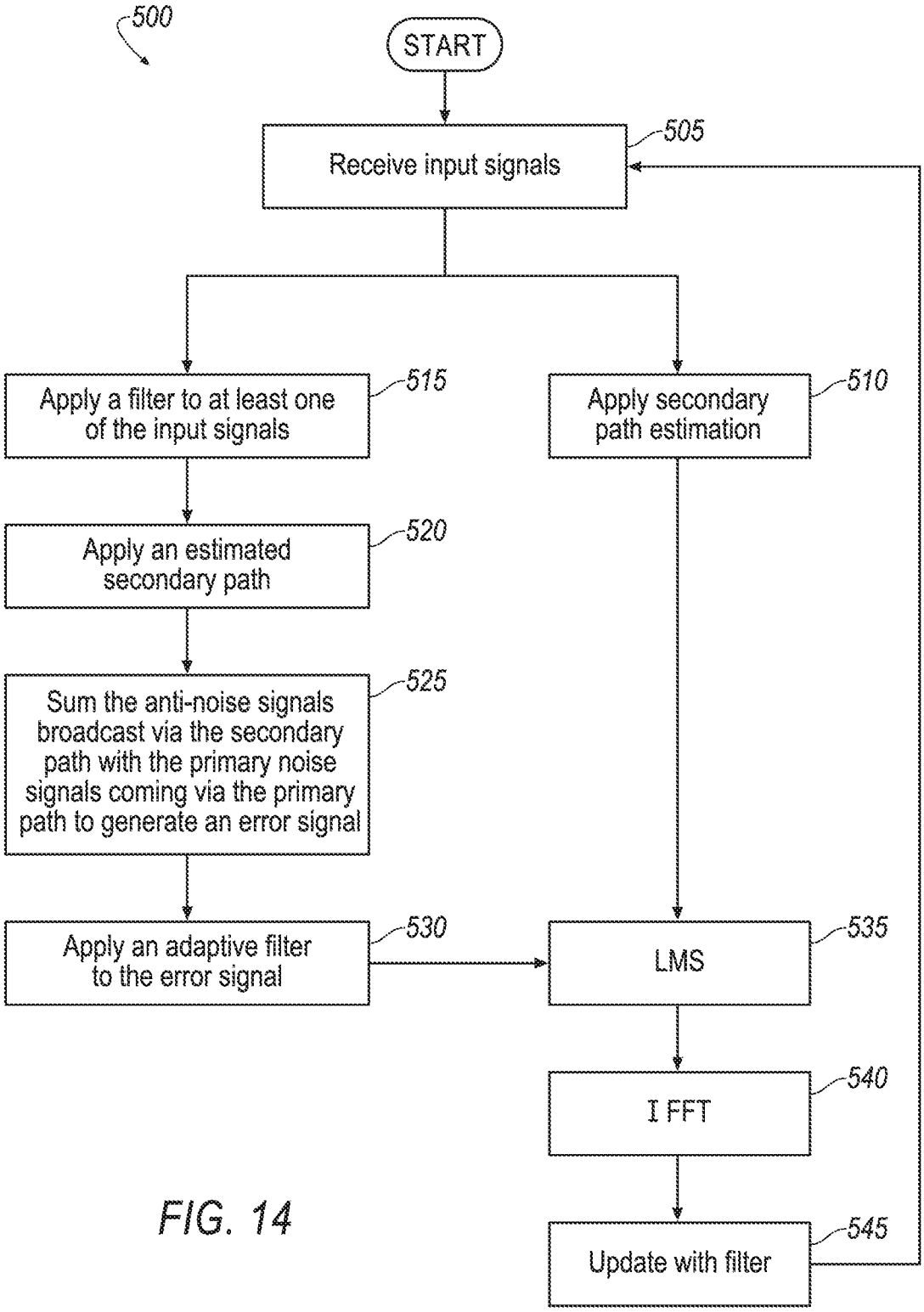
FIG. 14 illustrates an example process for adaptive error filtering corresponding to the system of FIGS. 2 and 3 above.

FIG. 14 illustrates an example process 500 for adaptive reference filtering corresponding to the system of FIGS. 12 and 13 above. The process 500 may begin at block 505 where the controller 105 receives input signals including narrowband input signal from the input sensor 110.

At block 515, the controller 105 may apply a filter to at least one of the input signals $x_{rn}[n]$, $x_{rb}[n]$. The filter may include a bandpass filter such as the bandpass filter 156. The filter may be an adaptive filter such as the narrowband adaptive filter 160.

At block 520, the controller 105 may generate a secondary path representing the electroacoustic transfer function of the system, similar to the secondary path estimate block 158 of FIGS. 2 and 3.

At block 525, the controller 105 may sum the antinoise and primary noise to generate an error signal. In this example, the antinoise signals broadcast over the secondary path $s_{l,m}[n]$ 176 is summed with the noise coming from the primary paths 152, and 154, resulting in an estimated error signal $E_m[n]$.

At block 530, the controller 105 may apply an adaptive filter (e.g., the harmonic notch filter 182 of Wiener filter 186) to the estimated error signal. The adaptive filter may filter out the harmonic signals in the error signal $e_m[n]$. The broadband signal may then adapt without the narrowband signal and without taking into consideration the harmonic noise in the error signal $e_m[n]$.

At block 510, the controller 105 may apply secondary path estimate to the input signals.

At block 535, the controller 105 may take the least means square (LMS) of the filtered error signal from block 530 and the secondary estimation from block 510.

At block 540, the controller 105 may take the IFFT of the signal.

At block 545, the controller 105 may update the system with the filter based on the process 500.

The process 500 may then end.

Figure 15:
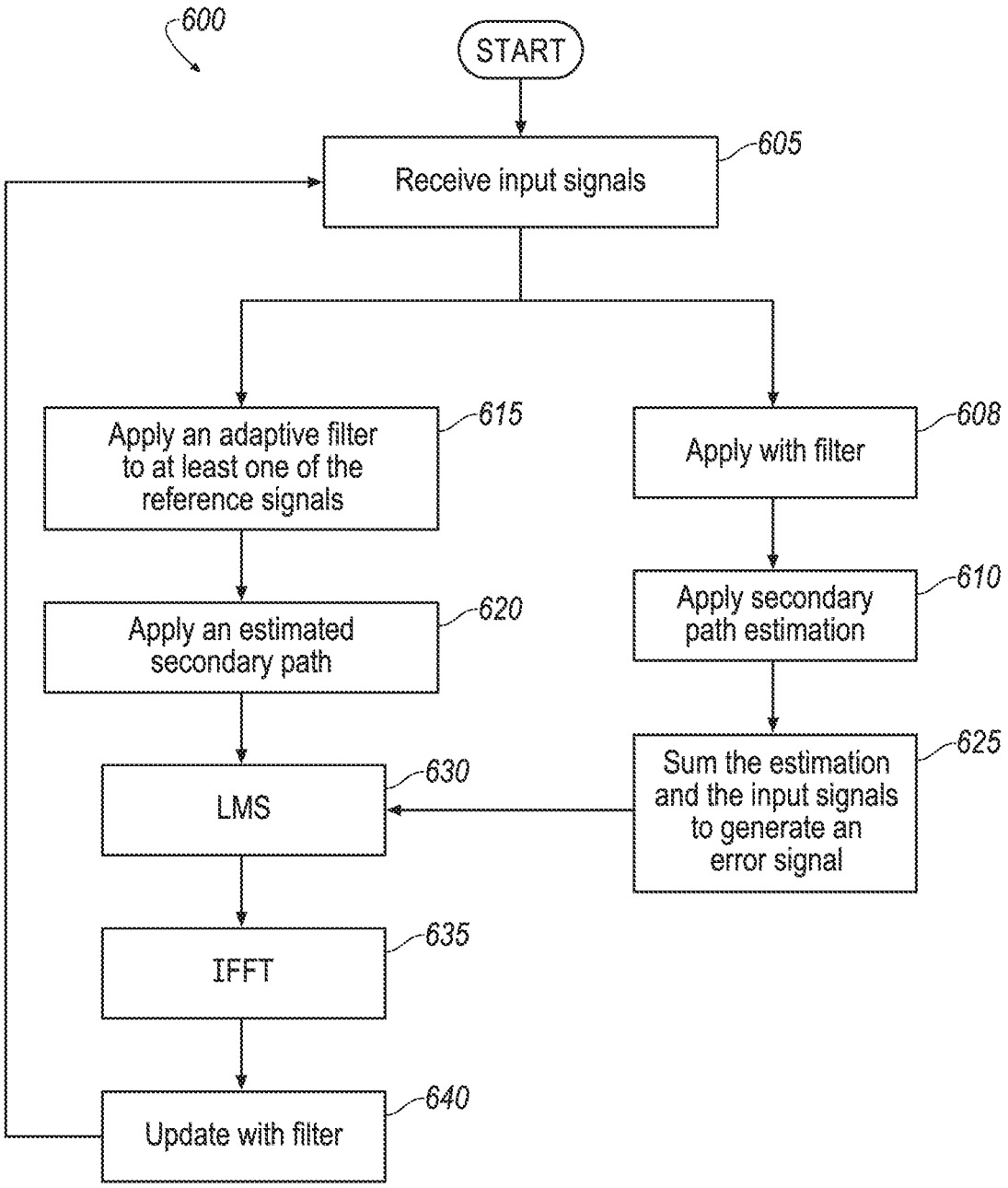
FIG. 15 illustrates an example process 600 for adaptive reference filtering corresponding to the system of FIG. 4 above.

FIG. 15 illustrates an example process 600 for adaptive reference filtering corresponding to the system of FIG. 4 above. The process 600 may begin at block 605 where the controller 105 receives input signals including narrowband input signals and broadband input signals from the input sensor 110 (or multiple narrowband signals).

At block 615, the controller 105 may apply an adaptive filter (e.g., the harmonic notch filter 182 of Wiener filter 186) to one or more of the input signals. The adaptive filter may filter out the harmonic signals in the reference. In one example, the adaptive notch filter 192 is illustrated in FIG. 4 as receiving both the narrowband reference signal $x_{rn}[n]$ and the broadband reference signal $x_{rb}[n]$. However, in another example, the adaptive notch filter 192 may only receive the broadband reference signal $x_{rb}[n]$. In this latter example, the adaptive notch filter 192 may filter harmonic content from the broadband reference signal $x_{rb}[n]$ in an effort to avoid duplicity of the harmonic content in both the narrowband and broadband. If both the narrowband and broadband include similar harmonic noise, and each of the narrowband and broadband are filtered separately, then the narrowband filtering may cancel the same frequency content as the broadband filtering. This may create instability or boosting and lead to poorer noise cancelation.

At block 620, the controller 105 may apply a secondary path representing the electroacoustic transfer function of the system, similar to the secondary path estimate block 158 of FIG. 4.

At block 608, the controller 105 may apply a filter to the input signals.

At block 612, the controller 105 may apply a secondary path estimation to the filtered input signal.

At block 625, the controller 105 may sum the antinoise and primary noise signals to generate an error signal. In this example, the antinoise signals broadcast over the secondary path $s_{l,m}[n]$ 176 is summed with the noise coming from the primary paths 152, and 154, resulting in an estimated error signal $E_m[n]$.

At block 630, the controller 105 may take the least means square (LMS) of the secondary estimation from block 620 and block 612.

At block 630, the controller 105 may take the least means square (LMS) of the filtered error signal from block 530 and the secondary estimation from block 510.

At block 635, the controller 105 may take the IFFT of the signal.

At block 640, the controller 105 may update the system with the filter based on the process 600.

The process 600 may then end.

Figure 16:
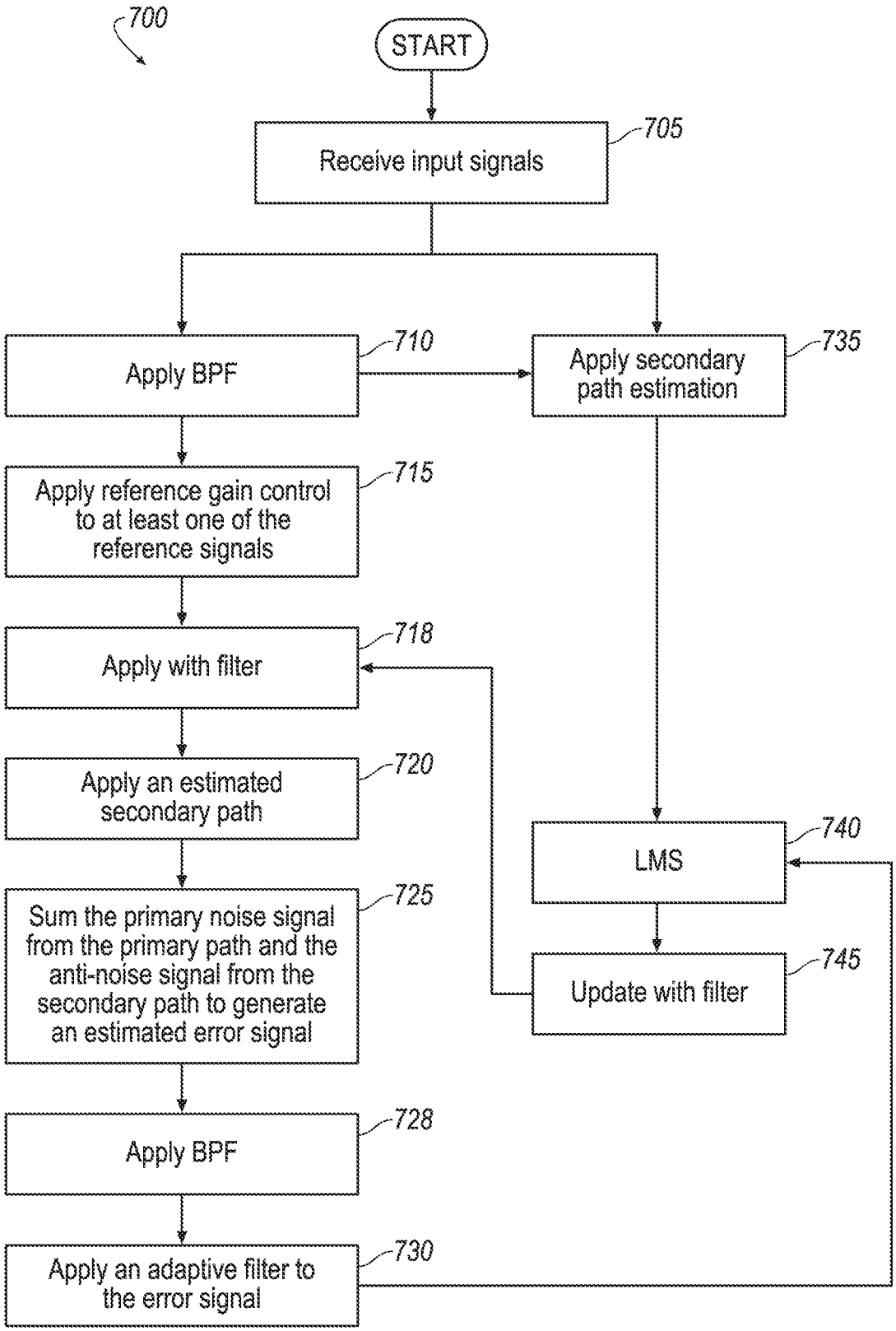
FIG. 16 illustrates an example process 700 for adaptive error filtering corresponding to the system of FIG. 11 above.

FIG. 16 illustrates an example process 700 for adaptive reference filtering corresponding to the system of FIGS. 10 and 11 above. The process 700 may begin at block 705 where the controller 105 receives input signals including at least two narrowband input signals from the input sensor 110.

At block 710, the controller 105 may apply a band pass filter to the input signals.

At block 715, the controller 105 may apply a reference gain control 346 to tune the filtered input signals $x_{r1}[n]$, $x_{r2}[n]$ to favor the cancellation of one noise signal over the other.

At block 718, the controller 105 may apply a filter to the referenced gain controlled signal of block 715.

At block 720, the controller 105 may generate a secondary path representing the electroacoustic transfer function of the system, similar to the secondary path estimate block 358 of FIGS. 10 and 11.

At block 725, the controller 105 may sum the primary noise signal from the primary path and the anti-noise signal from the secondary path to generate an estimated error signal.

At block 718, the controller 105 may apply a band pass filter to the summed signal.

At block 730 the controller 105 may apply an adaptive filter (e.g., the adaptive notch filters 392, 393) to the filtered estimated error signal. The adaptive filter may filter out the harmonic signals in the error signal $e_m[n]$.

At block 735, the controller 105 may apply secondary path estimate to the input signals.

At block 740, the controller 105 may take the least means square (LMS) of the filtered error signal from block 730 and the secondary estimation from block 735.

At block 745, the controller 105 may update the system with the filter based on the process 700.

The process 700 may then end.

The embodiments of the present disclosure generally provide for a plurality of circuits, electrical devices, and at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any controller as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any controller as disclosed utilizes any one or more microprocessors to execute a computer-program that is embodied in a non-transitory computer readable medium that is programmed to perform any number of the functions as disclosed. Further, any controller as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware based inputs and outputs for receiving and transmitting data, respectively from and to other hardware based devices as discussed herein.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A noise cancellation system with harmonic filtering for a vehicle audio system, comprising: at least one input sensor configured to transmit reference signals; at least one input sensor configured to transmit at least two narrowband input signals each of the input signals including harmonic noise; a processor being programmed to: receive the reference signals, the reference signals including at least two narrowband reference signals, receive the narrowband input signals, apply a gain reference control to the reference signals to determine whether the frequencies of each of the reference signals are within a predefined range of another, and apply a secondary path based on the reference signals to generate antinoise signals, sum the antinoise and the input signals to generate an error signal at an output sensor, apply a bandpass filter to one of the reference signals; apply an adaptive filter to the error signal to remove harmonic noise from the error signal, and remove one of the reference signals in response to the frequencies of each of the reference signals being within the predefined range of another to prevent common harmonic content from presiding on both reference signals during the algorithm adaption.

2. The system of claim 1, wherein the adaptive filter includes at least one harmonic notch filter.

3. The system of claim 2, wherein the processor is further configured to apply a narrowband adaptive filter to the input reference signals after applying a gain control.

4. The system of claim 1, wherein the adaptive filter includes at least one Wiener filter.

5. The system of claim 1, wherein the processor is further configured to apply a bandpass filter to the narrowband reference signals prior to generating the secondary path.

6. A noise cancellation system with harmonic filtering for a vehicle audio system, comprising: a processor coupled to memory and a transducer and being programmed to: receive at least two narrowband reference signals, apply a gain reference control the reference signals to determine whether the frequencies of each of the reference signals are within a predefined range of another, apply a secondary path to generate antinoise signals, sum the antinoise signals and the primary noise signals to generate an error signal, apply an adaptive filter to the error signal to remove harmonic noise from one of the narrowband reference signals to prevent common harmonic content from presiding on both reference signals during the algorithm adaption.

7. The system of claim 6, wherein the adaptive filter includes at least one harmonic notch filter.

8. The system of claim 6, wherein the adaptive filter includes at least one Wiener filter.

9. The system of claim 6, wherein the processor is further configured to apply a narrowband adaptive filter to the narrowband reference signal.

10. A noise cancellation system method with harmonic filtering for a vehicle audio system, comprising: receiving at least two narrowband reference signals, applying a gain reference control to the narrowband reference signals to determine whether the frequencies of each of the reference signals are within a predefined range of another, applying a secondary path to generate antinoise signals, summing the antinoise signals and the primary noise signals to generate an error signal, apply an adaptive filter to the error signal to remove harmonic noise from one of the narrowband reference signals.

11. The system of claim 10, further comprising applying a bandpass filter to the narrowband reference signal prior to generating the secondary path.

* * * * *